US005464548A

United States Patent [19]

Cahoon et al.

[11] Patent Number: 5,464,548

[45] Date of Patent: Nov. 7, 1995

[54] LUBRICANTS, FUNCTIONAL FLUID AND GREASE COMPOSITIONS CONTAINING SULFITE OR SULFATE OVERBASED METAL SALTS AND METHODS OF USING THE SAME

[75] Inventors: John M. Cahoon, Mentor; Jack L. Karn, Richmond Hts.; Nai Z. Huang, Mayfield Hts., all of Ohio

[73] Assignee: The Lubrizol Corporation, Wickliffe, Ohio

[21] Appl. No.: 289,354

[22] Filed: Aug. 11, 1994

Related U.S. Application Data

[63] Continuation of Ser. No. 996,756, Dec. 24, 1992, abandoned.

[51] Int. Cl.[6] ..... C10M 135/10; C10M 125/00

[52] U.S. Cl. ..... 252/18; 252/32.7 E; 252/33; 252/33.2; 252/45; 252/49.6; 252/49.7; 252/49.8

[58] Field of Search ..... 252/18, 33

[56] References Cited

U.S. PATENT DOCUMENTS

| | | | |
|---|---|---|---|
| Re. 27,331 | 4/1972 | Coleman | 252/47.5 |
| 1,726,647 | 9/1929 | Cadwell | 558/237 |
| 1,736,429 | 11/1929 | Cadwell | 558/237 |
| 2,623,016 | 12/1952 | Mertes | 252/32.7 |
| 3,197,405 | 7/1965 | Le Seer | 252/32.7 |
| 3,492,231 | 1/1970 | McMillen | 252/33 |
| 3,498,915 | 3/1970 | Coleman | 252/47.5 |
| 3,544,465 | 12/1970 | Braid | 252/46.6 |
| 3,819,521 | 6/1974 | Sims | 252/18 |
| 3,853,772 | 12/1974 | Adams | 252/18 |
| 3,876,550 | 4/1975 | Holubec | 252/47.5 |
| 3,907,601 | 9/1975 | Schaefer | 136/131 |
| 3,997,454 | 12/1976 | Adams | 252/18 |
| 4,089,790 | 5/1976 | Adams | 252/18 |
| 4,119,549 | 10/1978 | Davis | 252/45 |
| 4,119,550 | 10/1978 | Davis et al. | 252/45 |
| 4,191,659 | 3/1980 | Davis | 252/45 |
| 4,234,435 | 11/1980 | Meinhardt et al. | 252/51.5 |
| 4,308,154 | 12/1981 | Clason et al. | 252/32.7 |
| 4,344,854 | 8/1982 | Davis et al. | 252/45 |
| 4,417,990 | 11/1983 | Clason et al. | 252/32.7 |
| 4,560,488 | 12/1985 | Vinci | 252/33 |
| 4,579,666 | 4/1986 | Schroeck | 252/32.7 |
| 4,582,618 | 4/1986 | Davis | 252/32.7 |
| 4,584,115 | 4/1986 | Davis | 252/49.6 |
| 4,670,169 | 6/1987 | Adams et al. | 252/46.7 |
| 4,744,920 | 5/1988 | Fischer et al. | 252/33.4 |
| 4,755,311 | 7/1988 | Buries et al. | 252/49.9 |
| 4,758,362 | 7/1988 | Butke | 252/47.5 |
| 4,792,410 | 12/1988 | Schwind et al. | 252/30 |
| 4,876,374 | 10/1989 | Adams et al. | 558/109 |
| 4,965,003 | 10/1990 | Schlicht | 252/33 |
| 4,997,969 | 3/1991 | Luciani | 558/240 |
| 5,064,545 | 11/1991 | Steckel | 252/32.7 |

FOREIGN PATENT DOCUMENTS

| | | |
|---|---|---|
| 210448 | 4/1956 | Australia . |
| 1242102 | 9/1968 | United Kingdom . |
| 1315848 | 7/1970 | United Kingdom . |

*Primary Examiner*—Ellen M. McAvoy
*Attorney, Agent, or Firm*—Frederick D. Hunter; John H. Engelmann; William J. Connors

[57] ABSTRACT

The invention includes a lubricating composition comprising a major amount of an oil of lubricating viscosity, and a minor amount of (A) a sulfite or sulfate overbased or borated overbased metal salt of an acidic organic compound, wherein the lubricating composition contains less than 1.5% by weight of the reaction product of a polyisobutene substituted succinic anhydride and a polyamine, and provided that when (A) is a sulfate overbased or borated overbased metal salt, then the lubricating composition includes (B) at least one phosphorous of boron antiwear/extreme pressure agent, or (C) a sulfur compound. The invention also includes grease and functional fluids containing the sulfite and sulfate overbased metal salts. These composition have improved antiwear, antiweld, and extreme pressure properties.

32 Claims, No Drawings

LUBRICANTS, FUNCTIONAL FLUID AND GREASE COMPOSITIONS CONTAINING SULFITE OR SULFATE OVERBASED METAL SALTS AND METHODS OF USING THE SAME

This is a continuation of application Ser. No. 07/996,756 filed on Dec. 24, 1992, now abandoned.

TECHNICAL FIELD OF THE INVENTION

This invention relates to lubricating and grease compositions containing sulfite and sulfate overbased metal salts of organic compounds

BACKGROUND OF THE INVENTION

Lubricating compositions, greases, and aqueous fluids are used to maintain a film of lubricant between surfaces which are moving with respect to each other. The compositions prevent contact of the moving surfaces thus preventing harmful wear to the surfaces. The compositions generally also lower the coefficient of friction. To be effective, the compositions must have sufficient antiwear, antiweld, and extreme pressure properties to prevent metal-to-metal contact under high load conditions. There is a desire to have a material or combinations of materials which provide lubricating compositions with antiwear, antiweld, extreme pressure and/or friction properties.

One problem associated with boundary lubrication occurs under high speed, shock loading conditions. Under these conditions, the lubricant is exposed to a quick heavy load which may cause metal-to-metal contact. The L-42 high speed, shock loading test measures a lubricants ability to protect under high speed, shock loading conditions.

SUMMARY OF THE INVENTION

The invention includes a lubricating composition comprising a major amount of an oil of lubricating viscosity, and a minor amount of (A) a sulfite or sulfate overbased or borated overbased metal salt of an acidic organic compound, wherein the lubricating composition contains less than 1.5 % by weight of the reaction product of a polyisobutene substituted succinic anhydride and a polyamine, and provided that when (A) is a sulfate overbased or borated overbased metal salt, then the lubricating composition includes (B) at least one phosphorous of boron antiwear/extreme pressure agent, or (C) a sulfur compound. The invention also includes grease and functional fluids containing the sulfite and sulfate overbased metal salts. These composition have improved antiwear, antiweld, and extreme pressure properties.

DESCRIPTION OF THE PREFERRED EMBODIMENTS

As used in the specification and appended claims a sulfite overbased metal salt contains a salt which is composed of a metal cation and a $SO_x$ anion where x is a number from 2 to about 4. The salts may be sulfite, sulfate or mixtures of sulfite and sulfate salts.

SULFITE AND SULFATE OVERBASED SALTS

The present invention includes (A) a sulfite or sulfate overbased or borated overbased metal salt of an organic compound. The overbased salts are characterized by a metal content in excess of that which would be present according to the stoichiometry of the metal and the particular organic compound reacted with the metal. The amount of excess metal is commonly expressed in terms of metal ratio. The term "metal ratio" is the ratio of the total equivalents of the metal to the equivalents of the acidic organic compound. A salt having 4.5 times as much metal as present in a normal salt will have metal excess of 3.5 equivalents per equivalents of organic acid or a ratio of 4.5. In the present invention, these salts preferably have a metal ratio from about 1.5, or from about 3. The salts may have a metal ratio up to about 40, or up to about 30, or up to about 25. In one embodiment, the metal salts have a metal ratio from about 10, preferably from about 12, up to about 30, preferably up to about 25.

The metal salts are typically alkali or alkaline earth metal salts. The metal salts include lithium, sodium, potassium, calcium and magnesium metal salts. The metal salts are prepared using a basic metal compound. Illustrative of basic metal compounds include hydroxides, oxides, alkoxides (typically those in which the alkoxy group contains up to 10 and preferably up to 7 carbon atoms), hydrides and amides of alkali or alkaline earth metals. Useful basic metal compounds include lithium hydroxide, sodium hydroxide, potassium hydroxide, magnesium oxide, calcium hydroxide, calcium oxide, and barium hydroxide. Especially preferred are sodium hydroxide and the sodium lower alkoxides (i.e., those containing up to 7 carbon atoms).

The acidic organic compounds are selected from the group consisting of carboxylic acids, sulfonic acids, phosphorus acids, phenols, and derivatives thereof. Preferably, the overbased materials are prepared from sulfonic acids, carboxylic acids, or derivatives of these acids, e.g. esters, anhydrides, etc.

The sulfonic acids are preferably mono-, di-, and tri-aliphatic hydrocarbon-substituted aromatic sulfonic acids. The hydrocarbon-substituent may be derived from a polyalkene. The polyalkenes include homopolymers and interpolymers of polymerizable olefin monomers having from 2 up to about 16, preferably about 6, more about 4 carbon atoms. The olefins may be monoolefins such as ethylene, propylene, 1-butene, isobutene, and 1-octene; or a polyolefinic monomer, such as 1,3-butadiene and isoprene. In one embodiment, the interpolymer is a homopolymer. An example of a preferred homopolymer is a polybutene, preferably a polybutene in which about 50% of the polymer is derived from isobutylene. The polyalkenes are prepared by conventional procedures.

The polyalkene is generally characterized as containing from at least about 8, or at least about 15, or at least about 20 carbon atoms. The polyalkene generally contains up to about 40 carbon atoms, or up to about 30 carbon atoms. In one embodiment, the polyalkenes have a $\overline{M}n$ from about 250, or from about 300 up to about 600, or up to about 500, or up to about 400. The abbreviation $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

Examples of sulfonic acids include mahogany sulfonic acids, bright stock sulfonic acids, petroleum sulfonic acids, mono- and polywax-substituted naphthalene sulfonic acids, saturated, hydroxy-substituted, and unsaturated paraffin wax sulfonic acids, wax-substituted benzene or naphthalenesulfonic acids, tetraisobutylene sulfonic acids, tetra-amylene sulfonic acids, dodecylbenzene sulfonic acids, didodecylbenzene sulfonic acids, dinonylbenzene sulfonic acids, sulfonic acids derived by the treatment of at least one of the above-described polyalkenes (preferably polybutene) with chlorosulfonic acid, and the like. The sulfonic acids include dodecyl benzene "bottoms" sulfonic acids. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention. The production of sulfonic acids is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

In one embodiment, the acidic organic compound may be a carboxylic acid, or derivative thereof. Suitable carboxylic acids include aliphatic, cycloaliphatic, and aromatic mono- and polybasic carboxylic acids. In one embodiment, the carboxylic acid, or derivative thereof, is an aliphatic acid, or derivative thereof, containing from about 8, or about 12. The carboxylic acid or derivative thereof generally contains up to about 50, or to about 25 carbon atoms. Illustrative carboxylic acids and derivatives thereof include 2-ethylhexanoic acid, palmitic acid, stearic acid, oleic acid, linoleic acid, behenic acid, polybutenyl substituted succinic acid or anhydride derived from polybutene ($\overline{M}n$ equals about 200–1500, preferably about 300–1500, more preferably about 800–1200), polypropylene substituted succinic acid or anhydride derived from polypropene ($\overline{M}n$ equal 200–2000, preferably about 300–1500, more preferably about 800–1200), acids formed by oxidation of petrolatum or of hydrocarbon waxes, commercially available mixtures of two or more carboxylic acids such as tall oil acids, and rosin acids, octadecyl-substituted adipic acid, stearylbenzoic acid and mixtures of these acids, and/or their derivatives.

In one embodiment, the carboxylic acid or derivative thereof is a hydrocarbyl-substituted carboxylic acylating agent. The acylating agents include halides, esters, anhydrides, etc., preferably acid, esters or anhydrides, more preferably anhydrides. Preferably the carboxylic acylating agent is a succinic acylating agent. The acylating agent may be derived from a monocarboxylic or polycarboxylic acylating agent and one or more of the above described polyalkenes. In one embodiment, the polyalkene is characterized by an $\overline{M}n$ (number average molecular weight) of at least about 400, or at least about 500. Generally, the polyalkene is characterized by an $\overline{M}n$ from about 500, or from about 700, or from about 800, or from about 900. The polyalkene is characterized by having a $\overline{M}n$ up to about 5000, or up to about 2500, or up to about 2000, or up to about 1500. In one embodiment, the polyalkene has a $\overline{M}n$ from about 400 up to about 800, preferably about 600. In one embodiment, the hydrocarbyl group of the carboxylic acylating agent has a $\overline{M}n$ from about 400 to about 1200, preferably about 400 to about 800.

In another embodiment, the hydrocarbyl group is derived from polyalkenes having an $\overline{M}n$ of at least about 1300 up to about 5000, and the $\overline{M}w/\overline{M}n$ value is from about 1.5, or about 1.8, or about 2.5. The hydrocarbyl group generally has a $\overline{M}n$ up to about 4, or to about 3.6, or to about 3.2. The hydrocarbyl-substituted carboxylic acylating agents are prepared by known procedures.

In another embodiment, the acylating agents are prepared by reacting the above described polyalkenes with an excess of maleic anhydride to provide substituted succinic acylating agents wherein the number of succinic groups for each equivalent weight of substituent group is from about 1.3 to about 4.5 succinic groups per equivalent weight of substituent groups. A suitable range is from about 1.4 up to 3.5, or up to about 2.5 succinic groups per equivalent weight of substituent groups. In this embodiment, the polyalkene has an $\overline{M}n$ from about 1300 to about 5000 and a $\overline{M}w/\overline{M}n$ of at least 1.5. A more preferred range for $\overline{M}n$ is from about 1500 to about 2800, and a most preferred range of $\overline{M}n$ is from about 1500 to about 2400.

Carboxylic acids or derivatives thereof (e.g. acylating agents) and their preparation are described in U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et at); and U.K. 1,440,219. The disclosures of these patents are hereby incorporated by reference.

In another embodiment, the acidic organic compound is an alkyloxyallcylene-acetic acid or alkylphenoxy-acetic acid, more preferably alkylpolyoxyalkylene-acetic acid or derivatives thereof. Some specific examples of these compounds include: iso-stearylpentaethyleneglycolacetic acid; iso-steaxyl-O— $(CH_2CH_2O)_5CH_2CO_2Na$; lauryl-O— $(CH_2CH_2O)_{2.5}CH_2CO_2H$; lauryl-O—$(CH_2CH_2O)_{3.3}CH_2CO_2H$; oleyl-O—$(CH_2CH_2O)_4CH_2CO_2H$; lauryl-O—$(CH_2CH_2O)_{4.5}CH_2CO_2H$; lauryl-O— $(CH_2CH_2O)_{10}CH_2CO_2H$; lauryl-O—$(CH_2CH_2O)_{16}CH_2CO_2H$; octyl-phenyl-O—$(CH_2CH_2O)_8CH_2CO_2H$; octyl-phenyl-O—$(CH_2CH_2O)_{19}CH_2CO_2H$; 2-octyldecanyl-O—$(CH_2CH_2O)_6CH_2CO_2H$. These acids are available commercially from Sandoz Chemical under the tradename Sandopan acids.

In another embodiment, the acidic organic compound is an aromatic carboxylic acid. A group of useful aromatic carboxylic acids are those of the formula

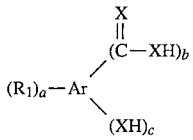

(XIII)

wherein $R_1$ is an aliphatic hydrocarbyl group derived from the above-described polyalkenes, a is a number in the range of 1 to about 4, usually 1 or 2, Ar is an aromatic group, each X is independently sulfur or oxygen, preferably oxygen, b is a number in the range from 1 to about 4, usually from 1 to 2, e is a number in the range of zero to about 4, usually 1 to 2, with the proviso that the sum of a, b, and c does not exceed the number of valences of At. Examples of aromatic acids include substituted benzoic, phthalic, and salicylic acids. The $R_1$ group is a hydrocarbyl group that is directly bonded to the aromatic group Ar. Examples of $R_1$ groups include substituents derived from the above described polyalkenes.

Ar may be mono- or polynuclear. Mononuclear groups include a phenyl, a pyridyl, or a thienyl. The polynuclear groups may be of the fused type wherein an aromatic nucleus is fused at two points to another nucleus such as found in naphthyl, anthranyl, etc. The polynuclear group can also be of the linked type are linked through bridging linkages such as alkylene, ether, keto, sulfide, and polysulfide, containing 2 to about 6 sulfur atoms, linkages. Examples of the aromatic groups include phenyl, phenylene, and naphthylene groups.

In one embodiment, the carboxylic acid or derivative thereof is a salicylic acid or derivative thereof. Preferably the salicylic acid or derivative thereof is an aliphatic hydrocarbon-substituted salicyclic acid or derivative thereof. The hydrocarbon substituent is generally derived from one or more of the above described polyalkenes.

The above aromatic carboxylic acids are known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791. These patents are incorporated by reference for their disclosure of aromatic carboxylic acids, salts thereof and methods of making the same.

In another embodiment, the acidic organic compound is a phosphorus-containing acid, or derivative thereof. The phosphorus-containing acids, or derivatives thereof, include phosphorus acids such as phosphoric acid or esters; and thiophosphorus acids or esters, including mono and dithiophosphorus acids or esters. In one embodiment, the phosphorus-containing acid is the reaction product of one or more of the above polyalkenes and a phosphorus sulfide. Useful phosphorus sulfides include phosphorus pentasulfide, phosphorus sesquisulfide, phosphorus heptasulfide and the like. The reaction of the polyalkene and the phosphorus sulfide generally may occur by simply mixing the two at a temperature above 80° C., usually between 100° C. and 300° C. Generally, the products have a phosphorus content from about 0.05% to about 10%, preferably from about 0.1% to about 5%. The relative proportions of the phosphorizing agent to the olefin polymer is generally from 0.1 part to 50 parts of the phosphorus sulfide per 100 parts of the polyalkene. The phosphorus-containing acids are described in U.S. Pat. No. 3,232,883 issued to Le Suer. This reference is herein incorporated by reference for its disclosure to the phosphorus-containing acids and methods for preparing the same.

In another embodiment, the acidic organic compound is a phenol. The phenols may be represented by the formula $(R_2)_a$—Ar—$(OH)_b$, wherein $R_2$ is defined above; Ar is an aromatic group, as defined above; a and b are independently numbers of at least one, the sum of a and b being in the range of two up to the total number of displacable hydrogens on the aromatic nucleus or nuclei of Ar. Preferably, a and b are independently numbers in the range of 1 to about 4, or to about 2. In one embodiment, $R_2$ and a are such that there is an average of at least about 8 aliphatic carbon atoms provided by the $R_2$ groups for each phenol compound.

In one embodiment, the overbased materials are prepared by reacting an acidic material, typically carbon dioxide, with a mixture comprising an acidic organic compound, a reaction medium comprising at least one inert, organic solvent for said organic material, a stoichiometric excess of the basic metal compound, typically a metal hydroxide or oxide, and a promoter. These metal salts and methods of making the same are described in U.S. Pat. No. 4,627,928. This patent is hereby incorporated by reference.

The promoters, that is, the materials which facilitate the incorporation of the excess metal into the overbased material, are also quite diverse and well known in the art. A comprehensive discussion of suitable promoters is found in U.S. Pat. Nos. 2,777,874; 2,695,910; 2,616,904; 3,384,586; and 3,492,231. These patents are incorporated by reference for their disclosure of promoters. In one embodiment, promoters include the alcoholic and phenolic promoters. The alcoholic promoters include the alkanols of one to about 12 carbon atoms such as methanol, ethanol, amyl alcohol, octanol, isopropanol, and mixtures of these and the like. Phenolic promoters include alkylated phenols such as, heptylphenols, octylphenols, and nonylphenols. Mixtures of various promoters are sometimes used.

The temperature at which the acidic material is contacted with the remainder of the reaction mass depends to a large measure upon the promoting agent used. With a phenolic promoter, the temperature usually ranges from about 80° C. to about 300° C., and preferably from about 100° C. to about 200° C. When an alcohol or mercaptan is used as the promoting agent, the temperature usually will not exceed the reflux temperature of the reaction mixture.

Acidic materials, which are reacted with the mixture of the acidic organic compound, the promoter, the metal compound and the reactive medium, are also disclosed in the above cited patents, for example, U.S. Pat. No. 2,616,904. Included within the known group of useful acidic materials are formic acid, acetic acid, nitric acid, boric acid, sulfuric acid, hydrochloric acid, hydrobromic acid, carbamic acid, substituted carbamic acids, etc. Acetic acid is a very useful acidic material. Inorganic acidic compounds such as HCl, $SO_2$, $SO_3$, $CO_2$, $H_2S$, $N_2O_3$, etc., may also be employed as the acidic materials. Preferred acidic materials are $SO_2$, $SO_3$, carbon dioxide and acetic acid, more preferably carbon dioxide.

The methods for preparing the overbased materials are well known in the prior art and are disclosed, for example, in the following U.S. Pat. Nos.: 2,616,904; 2,616,905; 2,616,906; 3,242,080; 3,250,710; 3,256,186; 3,274,135; 3,492,231; and 4,230,586. These patents disclose processes, materials which can be overbased, suitable metal bases, promoters, and acidic materials. These patents are incorporated herein by reference for these disclosures.

Other descriptions of basic sulfonate salts and techniques for making them can be found in the following U.S. Pat. Nos.: 2,174,110; 2,202,781; 2,239,974; 2,319,121; 2,337,552; 3,488,284; 3,595,790; and 3,798,012. These are hereby incorporated by reference for their disclosures in this regard.

In another embodiment, the overbased metal salts are borated overbased metal salts. Borated overbased metal salts are prepared by reacting a boron compound with an overbased metal salt or by using boric acid to overbase an acidic organic compound. Boron compounds include boron oxide, boron oxide hydrate, boron trioxide, boron trifluoride, boron tribromide, boron trichloride, boron acid such as boric acid, tetraboric acid and metaboric acid, boron hydrides, boron amides and various esters of boron acids. The boron esters are preferably lower alkyl (1–7 carbon atoms) esters of boric acid. A preferred boron compound is boric acid. Generally, the overbased metal salt is reacted with a boron compound at about 50° C. to about 250° C., preferably 100° C. to about 200° C. The overbased metal salt is generally reacted with a boron compound in amounts to provide at least about 0.5 %, or about 1% by weight boron to the composition. The overbased metal salt is generally reacted with a boron compound in an amount to provide up to about 5 %, or to about 4 %, or about 3 % by weight boron to the composition.

Borated overbased compositions, lubricating compositions containing the same and methods of preparing borated overbased compositions are found in U.S. Pat. No. 4,744,920, issued to Fischer et at; U.S. Pat. No. 4,792,410 issued to Schwind et al and PCT Publication WO88/03144. The disclosures relating to the above are hereby incorporated by reference.

The overbased metal salts may be prepared by using an acidic material other than a sulfurous acid, sulfurous ester, or sulfurous anhydride. When the overbased salt is prepared with acidic materials other than sulfurous acid, anhydride or esters, then the overbased salt is treated with a sulfurous acid, sulfurous anhydride, sulfurous ester, or a source thereof. This treatment displaces the acidic material with the sulfurous acid, sulfurous anhydride, or sulfurous ester. Generally an excess of sulfurous acid, ester, or anhydride is used to treat the overbased metal salts. Typically, from about 0.5 to about 1 equivalent of sulfurous acid, ester, or anhydride is reacted with each equivalent of overbased metal salts. Contacting a carbonated overbased or a borated carbonated overbased metal salt with a sulfurous acid or anhydride is preferred. The contacting is accomplished by techniques known to those in the art. Examples of sulfurous acids, anhydrides, and esters include sulfurous acid, ethylsulfonic acid, sulfur dioxide, thiosulfuric acid, dithionous acid, etc.

In one embodiment, the metal salts are treated with sulfur dioxide ($SO_2$). Generally an excess of sulfur dioxide is used. The contacting of the metal salt is continued until a desired amount of the acidic material is displaced by the sulfurous acid, anhydride, or ester. Generally, it is preferred to effect a complete or substantially complete displacement of the acidic material. The displacement of acidic material may conveniently be followed by infrared spectral, sulfur, or total base number analysis. When the acidic material is carbon dioxide, the decrease in the carbonate peak (885 $cm^{-1}$) shows the displacement of the carbon dioxide. The sulfite peak appears as a broad peak at 971 $cm^{-1}$. The sulfate peak occur as a broad peak at 1111 $cm^{-1}$. The temperature of the reaction can be from about room temperature up to the decomposition temperature of the reactants or desired product. Generally, the temperature is in the range of about 70° C. up to about 250° C., preferably from about 100° C. to about 200° C.

The following Examples 1–9 relate to sulfite and sulfate overbased and borated overbased metal salts of the present invention. Unless otherwise indicated, in the examples, as well as elsewhere in the specification and claims, the temperature is in degrees Celsius, the pressure is atmospheric and the parts and percentages are by weight.

EXAMPLE 1

A reaction vessel is charged with a mixture of 853 grams of methyl alcohol, 410 grams of blend oil, 54 grams of sodium hydroxide, and a neutralizing amount of additional sodium hydroxide. The amount of the latter addition of sodium hydroxide is dependent upon the acid number of the subsequently added sulfonic acid. The temperature of the mixture is adjusted to 49° C. A mixture (1070 grams) of straight chain dialkyl benzene sulfonic acid (molecular weight 430) and blend oil (42% by weight active content) is added to the vessel, while maintaining the temperature at 49°– 57° C. Polyisobutenyl ($\overline{M}n$=950)-substituted succinic anhydride (145 grams) is added to the reaction vessel. Then, 838 grams of sodium hydroxide are added to the reaction vessel. The temperature is adjusted to 71° C. The reaction mixture is blown with 460 grams of carbon dioxide. The mixture is flash stripped to 149° C., and filtered to clarity to provide the desired product. The product is an overbased sodium sulfonate having a base number (bromophenol blue) of 440, a metal content of 19.45% by weight, a metal ratio of 20, a sulfate ash content of 58% by weight, and a sulfur content of 1.35 % by weight.

The above overbased sodium sulfonate (1610 grams, 12.6 equivalents) is blown with an excess of $SO_2$ over an 8-hour period at a temperature of 135°–155° C. and a flow rate of 0.5–2 cfh. The overbased sodium sulfonate is reacted with 403 grams (12.6 equivalents) of SCh. The $CO_2$ level in the resulting product is 1.47% by weight. The total base number Coromophenol blue) is 218. The sulfur content is 12.1% by weight and the sodium content is 17.6% by weight.

EXAMPLE 2

A reaction vessel is charged with a mixture of 2400 grams of an alkylated benzene sulfonic acid, 308 grams of a polybutenyl succinic anhydride (equivalent weight of about 560), and 991 grams of mineral oil. Sodium hydroxide (1920 grams) and methanol (1920 grams) are added to the reaction vessel and mixed. The mixture is carbonated by intimately contacting it with carbon dioxide at a rate of 10 cfh for a total period of 110 minutes. During this period of time, the temperature of the reaction mixture initially rises to 98° C. and then slowly decreases to 76° C. over a period of about 95 minutes. The methanol and water are stripped from the reaction mixture by nitrogen gas at a rate of 2 cfh, as the temperature of the reaction mixture slowly is increased to 165° C. The mixture is vacuum stripped at 30 mm/Hg and 160° C. After vacuum stripping, the residue is filtered to yield an oil solution of the desired overbased sodium sulfonate having a metal ratio of 15:1.

The above overbased sodium sulfonate (9562.5 grams, 75 equivalents) is blown with sulfur dioxide at 140°–150° C. for 53 hours at 1.4 cubic feet per hour. The overbased sodium sulfonate is reacted with 2400 grams (75 equivalents) of sulfur dioxide. The reaction temperature is maintained for 48 hours and the contents are blown with nitrogen at 1 cubic foot per hour for twelve hours. The vessel contents are then filtered through diatomaceous earth. The filtrate is the desired product. The filtrate contains 13.1% sulfur and 17.7% nitrogen.

EXAMPLE 3

The overbased sodium sulfonate of Example 1 (3000 grams, 23.5 equivalents) is blown with $SO_2$ at a temperature of 140°–150° C. and a flow rate of 1.4 cfh for 8 hours. The overbased sodium sulfonate is reacted with 376 grams (11.75 equivalents) of $SO_2$. The resulting product is stored at room temperature for 16 hours under a nitrogen blanket and then filtered using diatomaceous earth. The product has 8.2% sulfur and 18.2% sodium.

EXAMPLE 4

A reaction vessel is charged with a mixture of 1000 grams of the overbased sodium sulfonate from Example 1, 0.13 gram of an anti-foaming agent (kerosene solution of Dow Coming 200 Fluid having a viscosity of 1000 Cst at 25° C.), and 133 grams of blend oil. The mixture is heated to 74°–79° C. with stirring. Boric acid (486 grams, 7.9 moles) is added to the mixture. The reaction mixture is heated to 121° C. to liberate water of reaction and 40–50% by weight of the $CO_2$ contained in the original overbased sodium sulfonate from Example 1. The reaction mixture is heated to 154°–160° C. and maintained at that temperature until the free and total water contents are reduced to 0.3% by weight or less and approximately 1–2% by weight, respectively. The reaction product is cooled to room temperature and filtered.

The above borated overbased sodium sulfonate (1750 grams, 10.0 equivalents) is blown with $SO_2$ at a temperature of 130° C. and a flow rate of 1.0 cfh for 15.5 hours and is reacted with 320 grams (10.0 equivalents) of $SO_2$. The resulting product is filtered using diatomaceous earth. The product has 7.26% sulfur, 12.6% sodium, and 6.06% boron.

EXAMPLE 5

A reaction vessel is charged at room temperature with a mixture of 794.5 Kg of polyisobutenyl ($\overline{M}n$=950) succinic anhydride, 994.3 Kg of SC-100 Solvent (a product of Ohio Solvents identified as an aromatic hydrocarbon solvent), 858.1 Kg of blend oil, 72.6 Kg of propylene tetramer phenol, 154.4 Kg of water, 113.5 grams of a kerosene solution of Dow Coming 200 having a viscosity 1000 cSt at 25° C., and 454 Kg of caustic soda flake. The reaction temperature of the mixture increases exothermically to 100° C. The reaction mixture is heated with stirring under reflux conditions to 137° C. over a period of 1.5 hours. The reaction mixture is blown with $CO_2$ at a rate of 45.4 Kg per hour for 5.9 hours. Aqueous distillate (146.2 Kg) is removed by nitrogen blowing from the reaction mixture. The reaction mixture is cooled to 82.2° C. and 429 Kg of organic distillate are added back to the reaction mixture. The reaction mixture is heated to 138° C., where 454 Kg of caustic soda are added. The reaction mixture is blown with $CO_2$ at a rate of 45.4 Kg per hour for 5.9 hours while maintaining the temperature at 135°–141° C. The reaction mixture is heated to 149° C. and maintained at that temperature until aqueous distillation ceases. Aqueous distillate (149.4 Kg) and organic distillate (487.6 Kg) are removed over a 5-hour period. The reaction mixture is flash stripped at 70 mm Hg absolute and 160° C. Aqueous distillate (32.7 Kg) and organic distillate (500.3 Kg) are removed from the reaction mixture. A 100 neutral mineral oil (858.1 Kg) is added to the reaction mixture. Diatomaceous earth (68.1 Kg) is added to the reaction mixture, and the mixture is filtered to provide the desired product. The resulting product has 38.99% sulfate ash, 12.63% sodium, 12.0% $CO_2$, a base number (bromophenol blue) of 320, a viscosity of 94.8 cSt at 100° C., and a specific gravity of 1.06.

The above sodium overbased succinate (3480 grams, 20 equivalents) is blown with $SO_2$ over an 15-hour period at a temperature of 140° C. and a flow rate of 1.35 cfh and is reacted with 640 grams (20 equivalents) of $SO_2$. The reaction mixture is then blown with nitrogen for 0.5 hour. The mixture is filtered through diatomaceous earth to provide 3570 grams of the desired product. The filtrate is the desired product and contains 8.52% sulfur and 13.25% sodium.

EXAMPLE 6

A mixture of 160 grams of blend oil, 111 grams of polyisobutenyl ($\overline{M}n$=950) succinic anhydride, 52 grams of n-butyl alcohol, 11 grams of water, 1.98 grams of Peladow (a product of Dow Chemical identified as containing 94–97% $CaCl_2$) and 90 grams of hydrated lime are mixed together. Additional hydrated lime is added to neutralize the subsequently added sulfonic acid, the amount of said additional lime being dependent upon the acid number of the sulfonic acid. 1078 grams of an oil solution (42% by weight active content) of a straight chain dialkyl benzene sulfonic acid (molecular weight 430) are added with the temperature of the reaction mixture not exceeding 79° C. The temperature is adjusted to 60° C. 64.5 grams of the reaction product of heptyl phenol, lime and formaldehyde, and 217 grams of methyl alcohol are added. The reaction mixture is blown with carbon dioxide to a base number (phenolphthalein) of 20–30. Hydrated lime (112 grams) is added to the reaction mixture, and the mixture is blown with carbon dioxide to a base number (phenolphthalein) of 45–60, while maintaining the temperature of the reaction mixture at 46°–52° C. The latter step of hydrated lime addition followed by carbon dioxide blowing is repeated three more times with the exception with the last repetition the reaction mixture is carbonated to a base number (phenolphthalein) of 45°–55. The reaction mixture is flash dried at 93°–104° C., kettle dried at 149°–160° C., filtered. The product is an overbased calcium sulfonate having a metal ratio of 12, and 1.:5% sulfur.

The above calcium overbased sulfonate (1122 grams, 6 equivalents) is blown with $SO_2$ at 120° for ten hours at 0.5 SCFH and is reacted with 192 grams (6 equivalents) of $SO_2$. The product was filtered through diatomaceous earth and the filtrate is the desired product. The product has 4.75% sulfur.

EXAMPLE 7

A mixture of 1000 grams of a primarily branched chain monoallcyl benzene sulfonic acid ($\overline{M}w$=500), 771 grams of o-xylene, and 75.2 grams of polyisobutenyl ($\overline{M}n$=950) succinic anhydride is prepared and the temperature is adjusted to 46° C. Then, 87.3 grams of magnesium oxide, 35.8 grams of acetic acid, 31.4 grams of methyl alcohol, and 59 grams of water are added to the mixture. The reaction mixture is blown with 77.3 grams of carbon dioxide at a temperature of 49°–54° C. 87.3 grams of magnesium oxide, 31.4 grams of methyl alcohol and 59 grams of water are added, and the reaction mixture is blown with 77.3 grams of carbon dioxide at 49°–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, 9.3% metal, a metal ratio 14.7, 46.0% sulfate ash, and 1.6% sulfur.

The above overbased magnesium sulfonate (1120 grams, 8 equivalents) is blown with $SO_2$ at 0.5 SCFH for fourteen hours and is reacted with 256 grams (8 equivalents) of $SO_2$. The mixture is heated to 120° C. and vacuum stripped at 10 mm Hg for 120° C. The residue is filtered through diatomaceous earth and the filtrate is the desired product. The filtrate has 2.6% sulfur, 8% magnesium, and a total base number of 359 (bromophenol blue).

EXAMPLE 8

The product of Example 1 (1100 grams, 4.4 equivalents, based on equivalents of sulfte) is charged to a reaction vessel and air blown for eight hours at 150° C. The vessel contents are cooled to 100° C. where 250 grams (2.2 equivalents) of a 30% solution of hydrogen peroxide is added dropwise over 1.5 hours. Distillate is removed and the mixture is heated to 135° C. Reaction is cooled to 120° C. where 250 grams (2.2 equivalents) of the above hydrogen peroxide solution is added to the mixture. The reaction temperature increases exothermically to 130° C. Infrared analysis indicates sulfate peaks (1111 $cm^{-1}$), and a decrease in sulfite peak (971 $cm^{-1}$). More hydrogen peroxide solution (25 grams, 0.2 equivalent) is added to the reaction vessel and the temperature is increased from 125° C. to 130° C. over two hours. The reaction mixture is blown with nitrogen at 157° C. to remove volatiles. The residue is centrifuged (1600 rpm). Liquid is decanted and stripped at 155° C. with nitrogen blowing. The residue is the product. The product has 12.4% sulfur, 52.2% sulfated ash, a base number (phenolphthalein) of 11, and a base number Coromophenol blue) of 60.

EXAMPLE 9

A reaction vessel is charged with 3700 grams (14.8 equivalents, based on sulfite) of the product of Example 1. The vessel contents are heated to 110 ° C. where 256 grams (2.3 equivalents) of a 30% hydrogen peroxide solution is added to the reaction vessel. Distillate is collected. An additional 1505 grams (13.28 equivalents) of 30% hydrogen peroxide solution is added to the reaction vessel over two hours. Water is removed by nitrogen blowing and the reaction temperature increases from 110° C. to 157° C. over two hours. The product is diluted with toluene and filtered through diatomaceous earth. The filtrate is transferred to a stripping vessel and blown with nitrogen at 1.5 standard cubic feet per hour at 150° C. The residue is the desired product. The product has 16.3% sodium, 11.9% sulfur, a base number (phenolphthalein) of 5.8, and a base number (bromophenol blue) of 39.

Phosphorus or Boron Agents (B)

In one embodiment, the sulfite or sulfate overbased product of the invention is used in combination with at least one phosphorus or boron containing antiwear/extreme pressure agent. In this embodiment, the phosphorus or boron containing antiwear/extreme pressure agent (B) is present in an amount sufficient to impart antiwear, antiweld, and/or extreme pressure properties to the lubricants and functional fluids. The phosphorus or boron containing agents (B) are typically present in the lubricants and functional fluids at a level of up to about 20% by weight, preferably up to about 10% by weight, based on the total weight of the lubricant, functional fluid, or grease. Typically, the phosphorus or boron containing antiwear/extreme pressure agent is present in the lubricants and functional fluids at a level from about 0.01%, or from about 0.05%, or from about 0.08% by weight. The phosphorus or boron containing antiwear/extreme pressure agent is present in an mount up to about 10%, or up to about 3%, or up to about 1% by weight.

Examples of phosphorus or boron containing antiwear/extreme pressure agents (B) include a metal thiophosphate; a phosphoric acid ester or salt thereof; a phosphite; a phosphorus-containing carboxylic ester; ether, or amide; a borated dispersant; an alkali metal borate; a borated overbased compound; a borated fatty mine; a borated phospholipid; and a borate ester. The phosphorus acids include the phosphoric, phosphonic, phosphinic and thiophosphoric acids including dithiophosphoric acid as well as the monothiophosphoric acid, thiophosphinic and thiophosphonic acids.

In one embodiment, (B) is a phosphorus acid ester prepared by reacting one or more phosphorus acid or anhydride with an alcohol containing from one, or about 3 carbon atoms. (B) generally contains up to about 30, preferably up to about 24, more preferably up to about 12 carbon atoms. The phosphorus acid or anhydride is generally an inorganic phosphorus reagent, such as phosphorus pentaoxide, phosphorus trioxide, phosphorus tetraoxide, phosphorus acid, phosphorus halide, lower phosphorus esters, or a phosphorus sulfide and the like. Lower phosphorus acid esters contain from 1 to about 7 carbon atoms in each ester group. The phosphorus acid ester may be a mono-, di- or triphosphoric acid ester. Alcohols used to prepare the phosphorus acid esters include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography)); and Alfol 22+ alcohols ($C_{18}$–$C_{28}$ primary alcohols containing primarily $C_{22}$ alcohols). Alfol alcohols are available from Continental Oil Company.

Another example of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric acid or anhydride with cresol alcohols. An example is tricresylphosphate.

In another embodiment, (B) is a thiophosphorus ester or salt thereof. The thiophosphorus acid ester may be prepared by reacting a phosphorus sulfide, such as those described above, with an alcohol, such as those described above. The thiophosphorus acid esters may be mono- or dithiophosphorus acid esters. Thiophosphorus acid esters are also referred to generally as thiophosphoric acids.

In one embodiment, the phosphorus acid ester is a monothiophosphoric acid ester or a monothiophosphate. In one embodiment, monothiophosphates are prepared by the reaction of a sulfur source with a dihydrocarbyl phosphite. The sulfur source may for instance be elemental sulfur. The sulfur source may also be a monosulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638, which are incorporated herein by reference for their disclosure of monothiophosphates, sulfur sources, and the process for making monothiophosphates. Monothiophosphates may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C. or higher) to form the monothiophosphate.

In another embodiment, (B) is a dithiophosphoric acid or phosphorodithioic acid. The dithiophosphoric acid may be represented by the formula $(R_6O)_2PSSH$ wherein each $R_6$ is independently a hydrocarbyl group containing from 3 to about 30 carbon atoms. $R_6$ generally contains up to about 18, or to about 12, or to about 8 carbon atoms. Examples $R_6$ include isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Illustrative lower alkylphenyl $R_6$ groups include butylphenyl, amylphenyl, heptylphenyl, etc. Examples of mixtures of $R_6$ groups include: 1-butanol and 1-octanol; 1-pentanol and 2-ethyl-1-hexanol; isobutanol and n-hexanol; isobutanol and isoamyl alcohol; 2-propanol and 2-methyl-4-pentanol; isopropanol and sec-butyl alcohol; and isopropanol and isooctyl alcohol.

In one embodiment, the dithiophosphoric acid may be reacted with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols having from 1 to about 12, preferably about 2 to about 6, more preferably 2 or 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. Nos. 3,197,405 and 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 5 14 grams of hydroxypropyl O,O-di(4-methyl-2-pentyl)phosphorodithioate (prepared by reacting di(4-methyl-2pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulfur, and an acid number of 87 Coromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and an acid number of 126 Coromophenol blue).

Acidic phosphoric acid esters may be reacted with an mine compound or metallic base to form an amine or metal salt. The salts may be formed separately and then the salt of the phosphorus acid ester may be added to the lubricating composition. Alternatively, the salts may also be formed in situ when the acidic phosphorus acid ester is blended with other components to form a fully formulated lubricating composition.

The amine salts of the phosphorus acid esters may be formed from ammonia, or an mine, including monoamines and polyamines. The mines may be primary amines, secondary amines or tertiary amines. Useful mines include those mines disclosed in U.S. Pat. No. 4,234,435 at Col. 21, line 4 to Col. 27, line 50, these passages being incorporated herein by reference.

The monoamines generally contain from 1 to about 24 carbon atoms, or to about 12, or to about 6 carbon atoms. Examples of monoamines include methylamine, ethylamine, propylamine, butylamine, octylamine, and dodecylamine, dimethylamine, diethylamine, dipropylamine, dibutylamine, methylbutylamine, ethylhexylamine, trimethylamine, tributylamine, methyldiethylamine, ethyldibutylamine, etc.

In one embodiment, the amine may be a fatty ($C_{4-30}$) amine which include n-hexylamine, n-octylamine, n-decylamine, n-dodecylamine, n-tetradecylamine, n-hexadecylamine, n-octadecylamine, oleyamine, etc. Also useful fatty mines include commercially available fatty mines such as "Armeen" amines (products available from Armak Chemicals, Chicago, Ill.), such as Armak's Armeen-C, Armeen-O, Armeen-OL, Armeen-T, Armeen-HT, Armeen S and Armeen SD, wherein the letter designation relates to the fatty group, such as cocoa, oleyl, tallow, or stearyl groups.

Other useful amines include primary ether amines, such as those represented by the formula, $R''(OR')_xNH_2$, wherein R' is a divalent alkylene group having about 2 to about 6 carbon atoms, x is a number from one to about 150 (preferably one), and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

The amines may be hydroxyamines, such as those represented by the formula

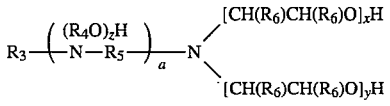

wherein: $R_3$ is a hydrocarbyl group generally containing from about 6 to about 30 carbon atoms; $R_4$ is an ethylene or propylene group; $R_5$ is an alkylene group containing up to about 5 carbon atoms; a is zero or one; each $R_6$ is hydrogen or a lower alkyl group; and x, y and z are each independently from zero to about 10, with the proviso that at least one of x, y or z is at least 1.

These hydroxyamines can be prepared by techniques well known in the art and many such hydroxyamines are commercially available. The hydroxy amines include mixtures of amines such as obtained by the hydrolysis of fatty oils (e.g., tallow oils, sperm oils, coconut oils, etc.). Specific examples of fatty mines, containing from about 6 to about 30 carbon atoms, include saturated as well as unsaturated aliphatic amines such as octyl amine, decyl amine, lauryl amine, stearyl amine, oleyl amine, dodecyl amine, and octadecyl amine.

Useful hydroxyamines wherein a in the above formula is zero include 2-hydroxyethyl,hexylamine; 2-hydroxyethyl, octylamine; 2-hydroxyethyl, pentadecylamine; 2-hydroxyethyl, oleylamine; 2-hydroxyethyl,soyamine;

bis(2-hydroxyethyl) hexylamine; bis(2-hydroxyethyl) oleylamine; and mixtures thereof. Also included are the comparable members wherein in the above formula at least one of x and y is at least 2, as for example, 2-hydroxyethoxyethyl, hexylamine.

A number of hydroxyamines wherein a in the above formula is zero are available from the Armak Chemical Division of Akzona, Inc., Chicago, Illinois, under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleyl amine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleyl amine with 2 moles propylene oxide.

Commercially available examples of alkoxylated amines where a in the above formula is one include Ethoduomeen T/13 and T/20 which are ethylene oxide condensation products of N-tallow trimethylene diamine containing 3 and 10 moles of ethylene oxide per mole of diamine, respectively.

The fatty polyamine diamines include mono- or dialkyl, symmetrical or asymmetrical ethylene diamines, propane diamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill. In one embodiment, the secondary amines may be cyclic amines such as piperidine, piperazine, morpholine, etc.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably the metal is magnesium, calcium, manganese or zinc. Examples of metal compounds which may be reacted with the phosphorus acid include zinc hydroxide, zinc oxide, copper hydroxide, copper oxide, etc.

In one embodiment, (B) is a metal thiophosphate, preferably a metal dithiophosphate. The metal thiophosphate is prepared by means known to those in the art. Examples of metal dithiophosphates include zinc isopropyl, methyl amyl dithiophosphate, zinc isopropyl isooctyl dithiophosphate, barium di(nonyl) dithiophosphate, zinc di(cyclohexyl) dithiophosphate, zinc di(isobutyl) dithiophosphate, calcium di(hexyl) dithiophosphate, zinc isobutyl isoamyl dithiophosphate, and zinc isopropyl secondary-butyl dithiophosphate.

The following Examples P-3 to P-6 exemplify the preparation of useful phosphorus acid ester salts.

EXAMPLE P-3

A reaction vessel is charged with 217 grams of the filtrate from Example P-1. A commercial aliphatic primary amine (66 grams), having an average molecular weight of 191 in which the aliphatic radical is a mixture of tertiary alkyl radicals containing from 11 to 14 carbon atom, is added over a period of 20 minutes at 25°– 60° C. The resulting product has a phosphorus content of 10.2% by weight, a nitrogen content of 1.5% by weight, and an acid number of 26.3.

EXAMPLE P-4

The filtrate of Example P-2 (1752 grams) is mixed at 25°–82° C. with 764 grams of the aliphatic primary amine used in of Example P-3. The resulting product has 9.95% phosphorus, 2.72% nitrogen, and 12.6% sulfur.

EXAMPLE P-5

Phosphorus pentoxide (852 grams) is added to 2340 grams of iso-octyl alcohol over a period of 3 hours. The temperature increases from room temperature but is maintained below 65 ° C. After the addition is complete the reaction mixture is heated to 90° C. and the temperature is maintained for 3 hours. Diatomaceous earth is added to the mixture, and the mixture is filtered. The filtrate has 12.4% phosphorus, a 192 acid neutralization number Coromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60°–70° C. under a pressure of 30 mm Hg. The resulting product mixture is faltered using a diatomaceous earth. The filtrate has 8.58% zinc and 7.03% phosphorus.

EXAMPLE P-6

Phosphorus pentoxide (208 grams) is added to the product prepared by reacting 280 grams of propylene oxide with 1184 grams of O,O,'-di-isobutylphosphorodithioic acid at 30°–60° C. The addition is made at a temperature of 50°–60° C. and the resulting mixture is then heated to 80 ° C. and held at that temperature for 2 hours. The commercial aliphatic primary amine identified in Example P-3 (384 grams) is added to the mixture, while the temperature is maintained in the range of 30–60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, (B) is a metal salt of (a) at least one dithiophosphoric acid and (b) at least one aliphatic or alicyclic carboxylic acid. The ditiophosphoric acids are described above. The carboxylic acid may be a monocarboxylic or polycarboxylic acid, usually containing from 1 to about 3, or just one carboxylic acid group. The preferred carboxylic acids are those having the formula $R_7COOH$, wherein $R_7$ is an aliphatic or alicyclic hydrocarbyl group preferably free from acetylenic unsaturation. $R_7$ generally contains from about 2, or from about 4 carbon atoms. $R_7$ generally contains up to about 40, or up to about 24, or to up about 12 carbon atoms. In one embodiment, $R_7$ contains from 4, or from about 6 up to about 12, or up to about 8 carbon atoms. In one embodiment, $R_7$ is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids and linoleic acid dimer. A preferred carboxylic acid is 2-ethylhexanoic acid.

The metal salts may be prepared by merely blending a metal salt of a dithiophoshoric acid with a metal salt of a carboxylic acid in the desired ratio. The ratio of equivalents of dithiophosphoric acid to carboxylic acid is from about 0.5 up to about 400 to 1. The ratio may be from 0.5 up to about 200, or to about 100, or to about 50, or to about 20 to 1. In one embodiment, the ratio is from 0.5 up to about 4.5 to 1, preferably about 2.5 up to about 4.25 to 1. For this purpose, the equivalent weight of a dithiophosphoric acid is its molecular weight divided by the number of —PSSH groups therein, and the equivalent weight of a carboxylic acid is its molecular weight divided by the number of carboxy groups therein.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., preferably up to about 125° C. U.S. Pat. Nos. 4,308,154 and 4,417,990 describe procedures for preparing these metal salts and disclose a number of examples of such metal salts. These patents are hereby incorporated by reference for those disclosures.

In another embodiment, (B) may also be a phosphite. The phosphite may be a di- or trihydrocarbyl phosphite. Generally, each hydrocarbyl group has from 1, or from about 2 carbon atoms. The hydrocarbyl group may contain up to about 24, or up to about 18, or up to about 8 carbon atoms. Examples of specific hydrocarbyl groups include propyl, butyl, hexyl, heptyl, octyl, oleyl, linoleyl, stearyl, phenyl, naphthyl, heptylphenol, and mixtures of two or more of thereof. In one embodiment, each hydrocarbyl group is independently propyl, butyl, pentyl, hexyl, heptyl, oleyl, or phenyl. Phosphites and their preparation are known and many phosphites are available commercially. Particularly useful phosphites are dibutyl phosphite, trioleyl phosphite and triphenyl phosphite.

In one embodiment, (B) is a phosphorus containing amide. The phosphorus containing amides are prepared by the reaction of one of the above describe phosphorus acids, preferably a dithiophosphoric acid, with an unsaturated amide. Examples of unsaturated amides include acrylamide, N,N'-methylene bisacrylamide, methacrylamide, crotonamide, and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807, and 4,876,374 which are incorporated by reference for their disclosures of phosphorus amides and their preparation.

In one embodiment, (B) is a phosphorus containing carboxylic ester. The phosphorus containing carboxylic esters are prepared by reaction of one of the above-described phosphorus acids, preferably a dithiophosphoric acid, and an unsaturated carboxylic acid or ester. If the carboxylic acid is used, the ester may then be formed by subsequent reaction of the phosphoric acid-unsaturated carboxylic acid adduct with an alcohol, such as those described herein. In one embodiment, the alcohol has from 1 to about 12 carbon atoms.

In one embodiment, the unsaturated carboxylic ester is a vinyl ester. The vinyl ester may be represented by the formula $R_8CH{=}CH{-}O(O)CR_9$, wherein $R_8$ is a hydrocarbyl group having from 1 to about 30, or to about 12 carbon atoms, preferably hydrogen, and $R_9$ is a hydrocarbyl group having 1 to about 30, or to about 12, or to about 8 carbon atoms. Examples of vinyl esters include vinyl acetate, vinyl 2-ethylhexanoate, vinyl butanoate, etc.

In one embodiment, the unsaturated carboxylic acid or ester includes maleic, fumaric, acrylic, methacrylic, itaconic, citraconic acids and esters. The ester may be represented by one of the formulae; $R_{10}C{=}C(R_{11})C(O)OR_{12}$, or $R_{12}O{-}(O)C{-}HC{=}CH{-}C(O)OR_{12}$, wherein each $R_{10}$ and $R_{12}$ are independently hydrogen or a hydrocarbyl group having 1 to about 18, or to about 12, or to about 8 carbon atoms, $R_{11}$ is hydrogen or an alkyl group having from 1 to about 6 carbon atoms. In one embodiment, $R_{11}$ is preferably hydrogen or a methyl group.

Examples of unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate and 2-ethylhexyl maleate. The above list includes mono- as well as diesters of maleic, fumaric and citraconic acids.

In one embodiment, (B) is a reaction product of a phosphorus acid, preferably a dithiophosphoric acid, and a vinyl ether. The vinyl ether is represented by the formula $R_{13}{-}CH_2{=}CH{-}OR_{14}$ wherein $R_{13}$ is independently hydrogen or a hydrocarbyl group having 1 to about 30, preferably to about 24, more preferably to about 12 carbon atoms. $R_{14}$ is a hydrocarbyl group defined the same as $R_{13}$. Examples of vinyl ethers include vinyl methylether, vinyl propylether, vinyl 2-ethylhexylether and the like.

In another embodiment, (B) is an alkali metal borate. Alkali metal borates are generally a hydrated particulate alkali metal borate which are known in the art. Alkali metal borates include mixed alkali and alkaline earth metal borates. These alkali metal borates are available commercially. Representative patents disclosing suitable alkali metal borates and their methods of manufacture include U.S. Pat. Nos. 3,997,454; 3,819,521; 3,853,772; 3,907,601; 3,997,454; and 4,089,790. These patents are incorporated by reference for their disclosures of alkali metal borates and methods of their manufacture.

In another embodiment, (B) is a borated overbased compound. The borated overbased compounds are described above. Examples of borated overbased compounds include borated overbased sodium sulfonate, borated overbased polybutenyl ($\overline{M}n$=950) substituted succinate, and borated overbased magnesium sulfonate.

In another embodiment, (B) is a borated fatty amine. The borated amines are prepared by reacting one or more of the above boron compounds with a fatty mine, e.g. an amine having from about four to about eighteen carbon atoms. The borated fatty mines are prepared by reacting the amine with the boron compound at about 50° C. to about 300° C., preferably about 100° C. to about 250° C., and at a ratio of 3:1 to 1:3 equivalents of amine to equivalents of boron compound.

The borated fatty epoxides are generally the reaction product of one or more of the above boron compounds, with at least one epoxide. The epoxide is generally an aliphatic epoxide having at least 8, preferably about 10, more preferably about 12, up to about 24, preferably 20 carbon atoms. Examples of useful aliphatic epoxides include heptyl oxide, octyl oxide, stearyl oxide, oleyl oxide and the like. Mixtures of epoxides may also be used, for instance commercial mixtures of epoxides having from 14 to about 16 carbon atoms and 14 to about 18 carbon atoms. The borated fatty epoxides are generally known and are disclosed in U.S. Pat. No. 4,584,115. This patent is incorporated by reference for its disclosure of borated fatty epoxides and methods for preparing the same.

In another embodiment, (B) is a borated phospholipid. The borated phospholipids are prepared by reacting a combination of a phospholipid and a boron compound, Optionally, the combination may include an amine, an acylated nitrogen compound, a carboxylic ester, a Mannich reaction product, or a basic or neutral metal salt of an organic acid compound. These additional components are described herein. Phospholipids, sometimes referred to as phosphatides and phospholipins, may be natural or synthetic. Naturally derived phospholipids include those derived from fish, fish oil, shellfish, bovine brain, chicken eggs, sunflowers, soybean, corn, and cotton-seed. Phospholipids may be derived from microorganisms, including blue-green algae, green algae, and bacteria.

The reactions usually occurs at a temperature from about 60° C., or about 90° C. up to about 200° C., up to about 150° C. The reaction is typically accomplished in about 0.5, or about 2 up to about 10 hours. The boron compound and phospholipid are reacted at an atomic proportion ratio of boron to phosphorus from about one up to about six to one, preferably from about two up to about four to one, more preferably about three to one. When the combination includes additional components, the boron compound is reacted with the mixture of the phospholipid and one or more optional ingredients in an amount of one atomic proponion of boron to an equivalent of the mixture of a phospholipid and an optional ingredient in a ratio from about (1:1), or about (2:1) up to about (6:1), to about (4:1). The equivalents of the mixture are based on the combined equivalents of phospholipid based on phosphorus and equivalents of the optional ingredients.

Sulfur Compounds

In one embodiment, the sulfite and sulfate metal salts (A) may be used in combination with a sulfur compound (C). The sulfur compounds include sulfurized organic compounds and dithiocarbamate containing compounds. The sulfite or sulfate metal salts (A) may be used with only the sulfur compound (C) or (A) may be used in combination with (C) and the phosphorus or boron containing compounds (B). In one embodiment, the sulfur compound is present in an mount from about 0.05%, or from about 1%, or from about 2% by weight of the lubricating composition. The sulfur compound is generally present in an amount up to about 10%, or up to about 7%, or up to about 6%

The sulfur compounds (C) include mono- or polysulfide compositions, or mixtures thereof. The sulfur compounds are generally characterized as having sulfide linkages containing an average from 1, or from about 2, or from about 3 sulfur atoms. The sulfur compounds generally contain up to about 10, or up to about 8, or up to about 4 sulfur atoms. In one embodiment, the sulfurized organic compositions are polysulfide compositions generally characterized as di-, tri- or tetra-sulfide compositions.

Materials which may be sulfurized to form (C) include oils, fatty acids or esters, olefins or polyolefins made therefrom, terpenes, or Diels-Alder adducts. Oils which may be sulfurized are natural or synthetic oils, including mineral oils, lard oil, carboxylic acid esters derived from aliphatic alcohols and fatty acids or aliphatic carboxylic acids (e.g., myristyl oleate and oleyl oleate) sperm whale oil and synthetic sperm whale oil substitutes and synthetic unsaturated esters or glycerides.

Fatty acids generally contain from about 4, or about 8, or about 12 carbon atoms. The fatty acids usually contain up to about 24, or to about 22, or to about 18 carbon atoms. The fatty acids include palmitoleic acid, oleic acid, linoleic acid, linolenic acid, erucic acid, lard oil acid, tall oil acid, soybean oil acid, etc.

The unsaturated fatty acid esters include fatty oils, that is, naturally occurring or synthetic esters of glycerol and one or more of the above fatty acids. Examples lo of fatty acid esters include animal fats such as Neat's-foot oil, lard oil, depot fat, beef tallow, vegetable oils include cottonseed oil, corn oil, safflower oil, sesame oil, soybean oil, sunflower seed oil, etc. The fatty acid esters also may be prepared by esterifying alcohols and polyols with a fatty acid. The alcohols include the above described mono- and polyhydric alcohols, such as methanol, ethanol, propanol, butanol, ethylene glycol, neopentyl glycol, glycerol, etc.

The olefins, which may be sulfurized, contain at least one olefinic double bond, which is defined as a non-aromatic double bond. In its broadest sense, the olefin may be defined by the formula $R^{*1}R^{*2}C{=}CR^{*3}R^{*4}$, wherein each of $R^{*1}$, $R^{*2}$, $R^{*3}$, and $R^{*4}$ is hydrogen, or an organic group. In general, the R* groups in the above formula which are not hydrogen may be represented by $-(CH_2)_n-A$, wherein n is a number from 0–10 and A is represented by $-C(R^{*5})_3$, $-COOR^{*5}$, $-CON(R^{*5})_2$, $-COON(-R^{*5})_4$, —COOM, —CN, —X, $-YR^{*5}$ or —Ar, wherein: each $R^{*5}$ is independently hydrogen, or a hydrocarbyl group, with the proviso that any two $R^{*5}$ groups may be connected to form a ring of up to about 12 carbon atoms is formed; M is one equivalent of a metal cation (preferably Group I or II, e.g., sodium, potassium, barium, calcium); X is halogen (e.g., chloro, bromo, or iodo); Y is oxygen or divalent sulfur; Ar is an aromatic group of up to about 12 carbon atoms.

The olefinic compound is usually one in which each R group which is not hydrogen is independently alkyl, alkenyl or aryl group. In one embodiment, $R^{*3}$ and $R^{*4}$ are hydrogen and $R^{*1}$ and $R^{*2}$ are alkyl or aryl, especially alkyl having 1 to about 30, or to about 16, or to about 8, or even to about 4 carbon atoms. Olefins having about 3 to about 30, or to about 16 (most often less than about 9) carbon atoms are particularly useful. Olefins having two to about 5 or to about 4 carbon atoms are particularly useful. Isobutene, propylene and their dimers, trimers and tetramers, and mixtures thereof are especially preferred olefins. Of these compounds, isobutylene and diisobutylene are particularly desirable.

The sulfurized olefins may be produced by reacting sulfur monochloride with an olefin, and then treating the resulting product with an alkali metal sulfide in the presence of free sulfur. The resulting product is then treated with an inorganic base. The sulfurized olefin may also be prepared by the reacting, under superatmospheric pressure, the olefin with a mixture of sulfur and hydrogen sulfide in the presence, or absence, of a catalyst, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same.

In another embodiment, (C) is a sulfurized terpene compound. The term "terpene compound" as used in the specification and claims is intended to include the various isomeric terpene hydrocarbons having the empirical formula $C_{10}H_{16}$, such as contained in turpentine, pine oil and dipentenes, and the various synthetic and naturally occurring oxygen-containing derivatives. Pine-oil derivatives, which are commercially available from Hercules Incorporated, include alpha-Terpineol (a high purity tertiary terpene alcohol); and Terpineol 318 Prime (a mixture containing about 60–65% weight alpha-terpineol and 15–20% weight beta-terpineol); Yarmor 302; Herco pine oil; Yarmor 302W; Yarmor F; and Yarmor 60.

In another embodiment, (C) is a sulfurized Diels Alder adduct. Generally, the molar ratio of sulfur source to Diels-Alder adduct is in a range of from about 0.75, preferably about 1, up to about 4.0, preferably up to about 3.0, more preferably up to about 2.5. The Diels-Alder adducts are a well-known, m-recognized class of compounds prepared from dienes by Diels-Alder reaction. A Diels-Alder reaction involves the reaction of at least one conjugated diene with at least one ethylenically or acetylenically unsaturated compound, these latter compounds being known as dienophiles. Piperylene, isoprene, methylisoprene, chloroprene, and 1,3-butadiene are among the preferred dienes for use in preparing the Diels-Alder adducts. Other dienes include linear 1,3-conjugated dienes, cyclic dienes, such as cyclopentadienes, fulvenes, 1,3-cyclohexadienes, 1,3,5-cycloheptatrienes, cyclooctatetraene, etc.

Dienophiles, used in preparing the Diels-Alder adducts, include nitroalkenes; alpha, beta-ethylenically unsaturated carboxylic esters, acids or amides; ethylenically unsaturated aldehydes and vinyl ketones. The unsaturated carboxylic esters, acids and amides are described above. Specific examples of dienophiles include 1-nitrobutene- 1, alkylacrylates, acrylamide, dibutylacrylamide, methacrylamide, crotonaldehyde; crotonic acid, dimethyl divinyl ketone, methylvinyl ketone, propiolaldehyde, methyl ethynyl ketone, propiolic acid, propargylaldehyde, cyclopentenedione, 3-cyanocoumaran, etc. The sulfurized Diels-Alder adducts are readily prepared by heating a mixture of a sulfur source, preferably sulfur and at least one of the Diels-Alder adducts of the types discussed hereinabove at a temperature within the range of from about 110 ° C. to just below the decomposition temperature of the Diels-Alder adducts. Temperatures within the range of about 110° to about 200° C. will normally be used. An example of a useful sulfurized Diels-Alder adduct is a sulfurized reaction product of butadiene and butyl-acrylate. Sulfurized Diels Alder adducts are described in U.S. Pat. Nos. 3,498,915, 4,582,618, and U.S. Pat. No. Re. 27331. These patents are hereby incorporated by reference for their disclosures of sulfurized Diels Alder adducts and methods of making the same.

In another embodiment, (C) is a dithiocarbamate containing compound. The dithiocarbamate-containing compounds include dithiocarbamate esters, dithiocarbamate amides, dithiocarbamic ethers, a sulfur coupled dithiocarbamates, and alkylene-coupled dithiocarbamates. Generally, a dithiocarbamic acid or salt is reacted with an unsaturated amide, ether, or ester to form the dithiocarbamate-containing compounds. The dithiocarbamic acid may be prepared by reacting one of the above described amines with carbon disulfide. In one embodiment, the amine is secondary amine. Specific amines include dimethyl amine, diethyl amine, dipropyl amine, dibutyl amine, diamyl amine, dihexyl amine, diheptyl amine, methylethyl amine, ethylbutyl amine, ethylamyl amine and the like. The unsaturated amide, ether, or esters are described above. The dithiocarbamic acids are reacted with the unsaturated compounds at a temperature of about 25° C., preferably about 50° C. to about 125° C., preferably to about 100° C.

In one embodiment, the dithiocarbamate containing composition is derived from the reaction product of a diamyl amine with carbon disulfide which forms a dithiocarbamic acid which is ultimately reacted with a acrylamide. In another embodiment, the dithiocarbamate acid is formed from diethylamine and carbon disulfide. The resulting dithiocarbamic acid is then reacted with methyl acrylate. U.S. Pat. Nos. 4,758,362 and 4,997,969 describe dithiocarbamate compounds and methods of making the same. These patents are hereby incorporated by reference for their disclosure of dithiocarbamate compounds and method of making the same.

In one embodiment, the dithiocarbamate-containing compound is an alkylene-coupled dithiocarbamate. The alkylene-coupled dithiocarbamates useful in the present invention may be prepared by the reaction of a salt of a dithiocarbamic acid, described above, with a suitable dihalogen containing hydrocarbon. The reaction is generally carried out at a temperature within the range of about 25° C. to about 150° C., or to about 100° C. U.S. Pat. No. 3,876,550 issued to Holubec describes alkylene dithiocarbamic compounds, and U.S. Pat. Nos. 1,726,647 and 1,736,429, issued to Cadwell describe, phenylmethylene bis(dithiocarbamates) and methods of making the same. These patents are incorporated by reference for their teachings related to dithiocarbamate compounds and methods for preparing the same. In one embodiment, the alkylene-coupled dithiocarbamate is derived from di-n-butyl amine, carbon disulfide and methylene dichloride.

In another embodiment, the dithiocarbamate-containing compound is a sulfur-coupled dithiocarbamate. The sulfur-coupled dithiocarbamates are prepared by reacting a di(halohydrocarbyl), dialdehyde, or diketo sulfur intermediate with a salt of a dithiocarbamate in an amount sufficient to replace the halo groups with dithiocarbamate groups or to react with both carbonyl groups of the dialdehyde or diketone intermediate. The metal salts of dithiocarbamates are known in the art and can be prepared readily by one skilled in the art. The salts of dithiocarbamic acids prepared by the above procedure generally are reacted immediately with the sulfur intermediates. The reaction between the sulfur intermediate and the dithiocarbamate salts generally is conducted at from ambient temperature to the reflux temperature of the mixture. The reaction is conducted until the reaction is completed which is generally from about 5 to about 24 hours. At the end of the reaction, the aqueous phase is separated, and the product is recovered from the organic phase.

The sulfur-coupled dithiocarbamates also may be prepared by a process which comprises the steps of (A)

reacting an olefinic hydrocarbon with a halogen to produce a halogen-containing intermediate, and (B) reacting said intermediate with an alkali metal sulfide and a salt of a dithiocarbamate in an amount sufficient to replace the halogen groups present partially with dithiocarbamate groups and/or partially with sulfide groups.

The sulfur-coupled dithiocarbamates are described in U.S. Pat. No. 2,599,350, issued to Rudel et al. This patent is incorporated by reference for its disclosure of sulfur-coupled dithiocarbamates.

Lubricants

As previously indicated, the sulfite and sulfate metal salts (A) are useful as additives for lubricants in which they can function primarily as antiwear, antiweld, extreme pressure, anticorrosion, antioxidation and/or friction modifying agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, tractor lubricants, metal-working lubricants, hydraulic fluids and other lubricating oil and grease compositions can also benefit from the incorporation therein of the compositions of the present invention.

The sulfite and sulfate metal salts may be used in lubricants or in concentrates. The concentrate contains the metal salts alone or in combination with other components used in preparing fully formulated lubricants. The concentrate also contains a substantially inert organic diluent, which includes kerosene, mineral distillates, or one or more of the oils of lubricating viscosity discussed below. In one embodiment, the concentrates contain from 0.01%, or from about 0.1%, or from about 1% up to about 70% or up to about 80%, even up to about 90% by weight of the sulfite or sulfate metal salts. These compositions may be present in a final product, blend or concentrate in any amount effective to act as an antiwear agent, antiweld, extreme pressure agent and/or friction modifying agent in lubricating compositions. The sulfite and sulfate metal salts are preferably present in the lubricating composition in an amount from about 0.01%, or from about 0.1%, or from about 0.5%, or from about 1% up to about 10%, or up to about 5% by weight. In one embodiment, when the compositions of the present invention are used in oils, such as gear oils, they are preferably present in an amount from about 0.1%, or about 0.5%, or about 1%, up to about 8%, or to 5%, by weight of the lubricating composition. When the metal salts are used in hydraulic fluids the salts are generally present in an amount from about 0.01%, or from about 0.3% by weight of the hydraulic fluid. The metal salts may be used in hydraulic fluids in an amount up to about 2%, or to about 1% by weight.

In one embodiment, the sulfite and sulfate metal salts are used in cutting fluids in combination with sulfur compounds. Generally the metal salts are used at a level from about 1%, or from about 2% by weight of the cutting fluid. The metal salts are used in the cutting fluid in an amount up to about 5%, or to about 3% by weight. In one embodiment, the cutting fluid is composed of a cutting fluid base stock, such as a 100 neutral mineral oil and a mixture of the sulfite or sulfate metal salts and a sulfur compound.

In one embodiment, the lubricating composition contains less than 1.5%, or less than 1.0%, or less than about 0.5% by weight of the reaction product of a polyisobutene substituted succinic anhydride and a polyamine. In another embodiment, the lubricating compositions, such as gear lubricants, contain less than 2%, or less than 1.5%, or less than 1% by weight of a dispersant, such as those described herein.

The lubricating compositions and methods of this invention employ an oil of lubricating viscosity, including natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity or a mixture of oils of lubricating viscosity are selected to provide lubricating compositions with a kinematic viscosity of at least about 3.5 cSt, or at least about 4.0 cSt at 100° C. In one embodiment, the lubricating compositions have an SAE gear viscosity number of at least about SAE 65, more preferably at least about SAE 75. The lubricating composition may also have a so-called multigrade rating such as SAE 75W-80, 75W- 90, 75W-90, or 80W-90. Multigrade lubricants may include a viscosity improver which is formulated with the oil of lubricating viscosity to provide the above lubricant grades. Useful viscosity improvers include polyolefins, such as ethylene-propylene copolymers, or polybutylene rubbers, including hydrogenated rubbers, such as styrene-butadiene or styrene-isoprene rubbers; or polyacrylates, including polymethacrylates. Preferably the viscosity improver is a polyolefin or polymethacrylate, more preferably polymethacrylate. Viscosity improvers available commercially include Acryloid™ viscosity improvers available from Rohm & Haas; Shellvis™ rubbers available from Shell Chemical; and Lubrizol 3174 available from The Lubrizol Corporation.

In another embodiment, the oil of lubricating viscosity is selected to provide lubricating compositions for crankcase applications, such as for gasoline and diesel engines. Typically, the lubricating compositions are selected to provide an SAE crankcase viscosity number of 10W, 20W, or 30W lubricants. The lubricating composition may also have a so called multi-grade rating such as SAE 5W-30, 10W- 30, 10W-40, 20W-50, etc. As described above, multi-grade lubricants include a viscosity improver which is formulated with the oil of lubricating viscosity to provide the above lubricant grades.

In one embodiment, the sulfite and sulfate metal salts are used in lubricating compositions together with either (B) the above phosphorus or boron containing antiwear/extreme pressure agent or (C) a sulfur compound. Lubricating compositions containing these combinations of these materials have improved wear and oxidation properties.

Other Additives

The invention also contemplates the use of other additives in combination with the sulfite or sulfate metal salts. These additives may be used in combination with the metals salts alone or in combination with either the phosphorus or boron containing antiwear/extreme pressure agent or the sulfur compounds. Such additives include, for example, detergents and dispersants corrosion- and oxidation-inhibiting agents, pour point depressing agents, extreme pressure agents, antiwear agents, color stabilizers and anti-foam agents.

The ash-producing detergents are exemplified by oil-soluble neutral and basic salts (i.e. overbased salts) of alkali or alkaline earth metals with sulfonic acids, carboxylic acids, phenols or organic phosphorus acids, such as those described above. The oil-soluble neutral or basic salts of alkali or alkaline earth metal salts may also be reacted with a boron compound. Boron compounds are described above. The overbased and borated overbased metal salts are described above.

Many types of detergents and dispersants are known in the art. The following are illustrative.

(1) "Carboxylic dispersants" are the reaction products of carboxylic acids (or derivatives thereof) containing at least about 34 and preferably at least about 54 carbon atoms and nitrogen containing compounds (such as mine), organic hydroxy compounds (such as phenols and alcohols), and/or basic inorganic materials. These reaction products include imide, amide, and ester reaction products of carboxylic acylating agents. The carboxylic dispersants are generally prepared by reacting one or more of the above described hydrocarbyl (described above) substituted carboxylic acylating agent with an amine or hydroxy containing compound such as an alcohol. Examples of these materials include succinimide dispersants and carboxylic ester dispersants. Examples of these "carboxylic dispersants" are described in British Pat. No. 1,306,529 and in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and U.S. Pat. No. Re. 26,433.

(2) "Amine dispersants" are the reaction products of relatively high molecular weight aliphatic or allcyclic halides and amines, preferably polyalkylene polyamines. These dispersants are described above as polyalkene-substituted amines. Examples thereof are described for example, in the following U.S. Pat. Nos.: 3,275,554, 3,438,757, 3,454,555, and 3,565,804.

(3) "Mannich dispersants" are the reaction products of alkylphenols and aldehydes (especially formaldehyde) and amines (especially amine condensates and polyalkylenepolyamines). The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

(4) "Post-treated dispersants" are the products obtained by post-treating the carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.: 3,200,107, 3,282,955, 3,367,943, 3,513,093, 3,639,242, 3,649,659, 3,442,808, 3,455,832, 3,579,450, 3,600,372, 3,702,757,and 3,708,422.

(5) "Polymeric dispersants" are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants include esters of styrene-maleic anhydride copolymers. Examples thereof are disclosed in the following U.S. Pat. Nos.: 3,329,658, 3,449,250, 3,519,656, 3,666,730, 3,687,849, and 3,702,300.

The above-noted patents are incorporated by reference herein for their disclosures of dispersants.

Auxiliary extreme pressure agents and corrosion- and oxidation-inhibiting agents which may be included in the lubricants of the invention are exemplified by chlorinated aliphatic hydrocarbons such as chlorinated wax; sulfurized alkylphenol; phosphosulfurized hydrocarbons, such as the reaction product of a phosphorus sulfide with turpentine or methyl oleate; metal thiocarbamates, such as zinc dioctyldithiocarbamate, and barium diheptylphenyl dithiocarbamate. Many of the above-mentioned extreme pressure agents and corrosion- and oxidation-inhibitors also serve as antiwear agents.

Pour point depressants are an additive often included in the lubricating oils described herein. Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Antifoam agents are used to reduce or prevent the formation of stable foam. Typical antifoam agents include silicones or organic polymers. Additional antifoam compositions are described in "Foam Control Agents", by Henry T. Kerner (Noyes Data Corporation, 1976), pages 125–162.

The following examples relate to lubricating compositions containing the sulfite and sulfate metal salts.

EXAMPLE I

A lubricant is prepared by incorporating 3% by weight of the product of Example 1 into a SAE 10W-40 lubricating oil mixture.

EXAMPLE II

A gear lubricant is prepared by incorporating 2.5% by weight of the product of Example 2 into an SAE 90 lubricating oil mixture.

EXAMPLE III

A gear lubricant is prepared by incorporating 6% by weight of the product of Example 1; 0.14% by weight of a formaldehyde coupled heptylphenol and dimercaptothiadiazole; and 0.075% of a silicone antifoam agent into an SAE 80W-90 lubricating oil mixture.

EXAMPLE IV

A lubricant is prepared as described in Example III except a SAE 10W-40 lubricating oil mixture is used in place of the SAE 80W-90 lubricating oil mixture.

EXAMPLE V

A gear lubricant is prepare by incorporating 3% by weight the product of Example 5, and 1.9% by weight of a zinc isopropyl, methylamyl dithiophosphate into an SAE 80W-90 lubricating oil mixture.

EXAMPLE VI

A lubricant is prepared as described in Example V except an SAE 10W-30 lubricating oil mixture is used in place of the SAE 80W-90 lubricating oil mixture.

EXAMPLE VII

A gear lubricant is prepared by incorporating 3% by weight the product of Example 1, and 0.5% by weight of a succinic dispersant prepared by reacting a polybutenyl-substituted succinic anhydride, with a polybutenyl group having a number average molecular weight of about 950, with a commercial polyamine having the equivalent structure of tetraethylene pentamine into a SAE 75W-90 lubricant oil mixture.

EXAMPLE VIII

A lubricant is prepared as described in Example VII except an SAE 10W-30 lubricating oil mixture is used in place of the SAE 75W-90 lubricant oil mixture.

EXAMPLE IX

A lubricant is prepared by incorporating 3.75% by weight of the product of Example 1; 2.4% by weight of a zinc di(2-ethylhexyl)dithiophosphate-2-ethylhexanoate prepared using zinc oxide, 2-ethylhexanoic acid, di(2-ethylhexyl)dithiophosphoric acid and triphenyl phosphite; 0.31% by weight of a carboxylic acid derivative solubilizer prepared by reacting N,N-diethylethanol mine with polybutylene succinic anhydride at a molar ratio of 1:1 wherein the polybutene succinic anhydride contains a substituent derived from a polybutene polymer having a number average molecular weight of about 1000; 1 percent by weight of a maleic anhydride-styrene copolymer esterified with $C_{8-18}$ and $C_4$ alcohols and post-treated with aminopropyl morpholine; 1% by weight of a sulfurized mixture of soybean oil and a mixture of alpha-olefins having sixteen and eighteen carbon atoms; and 3% by weight of a dithiocarbamate ester prepared by reacting dibutyl amine with carbon disulfide and methyl acrylate into an oil mixture containing 50% 250 neutral mineral oil and 50% 65 neutral mineral oil.

EXAMPLE X

A hydraulic fluid is prepared by mixing 0.5% by weight of the product of Example 4; 0.1% by weight of a neutral calcium sulfonate; 0.02% by weight of Tolad 370 demulsifier available commercially from Petrolite Chemical Company; 0.2% by weight of Ethyl Antioxidant 732; 0.01% by weight of tolytriazole; and 0.2% by weight of the esterified maleic anhydride-styrene copolymer of Example IX into a hydraulic base stock.

EXAMPLE XI

A tractor fluid is prepared by incorporating 3% by weight of the product of Example 9; 0.3% by weight of the esterified maleic anhydride-styrene copolymer of Example IX; and 6.6% by weight of 0840.1 into a mixture of 54.05% of a 70 neutral mineral oil; 27.02% of a 160 neutral mineral oil and 9% of Sun 40 napthenic oil.

EXAMPLE XII

A cutting fluid is prepared by incorporating 2.5% of the product of Example 1 and 2.5% of the reaction product of diisobutylene, sulfur, and hydrogen sulfide into a 100 neutral mineral oil.

Grease

Where the lubricant is to be used in the form of a grease, the lubricating oil generally is employed in an amount sufficient to balance the total grease composition and, generally, the grease compositions will contain various quantities of thickeners and other additive components to provide desirable properties. The sulfite or sulfate metal salts thereof are present in an amount from about 0.5%, or from about 1% by weight. The metal salts may be used in an amount up to about 10%, or to about 5% by weight.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearin, oleic acid, palmitic acid, myristic acid, cottonseed oil acids, and hydrogenated fish oils.

Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-intermediate- and high-molecular weight acids and of nut oil acids, aluminum stearate, and aluminum complex thickeners. Useful thickeners include hydrophilic clays which are treated with an ammonium compound to render them hydrophobic. Typical ammonium compounds are tetraalkyl ammonium chlorides. These clays are generally crystalline complex silicates. These clays include bentonite, attapulgite, hectorite, illite, saponite, sepiolite, biotite, vermiculite, zeolite clays and the like.

EXAMPLE G-1

A grease is prepared by incorporating 4% by weight of the product of Example 1 into a lithium grease, Southwest Petro Chem Lithium 12 OH Base Grease.

EXAMPLE G-2

A grease is prepared as described in Example G-1 except 5% by weight of the product of Example 8 is used in place of the product of Example 1.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating composition comprising a major amount of an oil of lubricating viscosity, and a minor amount of (A) a sulfite or sulfate overbased or borated overbased metal salt of an acidic organic compound, wherein the lubricating composition contains less than 1.5% by weight of a reaction product of a polyisobutene substituted succinic anhydride and a polyamine, and provided that when (A) is a sulfate overbased or borated overbased metal salt, then the lubricating composition includes (B) at least one phosphorous or boron antiwear/extreme pressure agent, or (C) a sulfur compound, wherein the sulfite overbased or borated overbased metal salt has a metal ratio from about 10 to about 40 and is derived from a carbonated overbased or borated overbased metal salt.

2. The composition of claim 1 wherein the metal salt of (A) is an alkali metal salt.

3. The composition of claim 1 wherein (A) is a sulfite or sulfate overbased sodium salt.

4. The composition of claim 1 wherein the acidic organic compound of (A) is a sulfonic acid or a carboxylic acid or anhydride.

5. The composition of claim 1 wherein (A) is prepared by reacting an overbased or borated overbased metal salt of an acidic organic compound with a sulfurous acid, sulfurous ester, or sulfurous anhydride.

6. The composition of claim 5 wherein the sulfurous acid, sulfurous ester, or sulfurous anhydride is sulfur dioxide.

7. The composition of claim 1 wherein (A) is an oxidized sulfite overbased or borated overbased metal salt of an acidic organic compound.

8. The composition of claim 7 wherein (A) is prepared by reacting the sulfite overbased or borated overbased metal salt with an oxidizing agent selected from oxygen, and a peroxide.

9. The composition of claim 1 wherein (A) is prepared by reacting an overbased or borated overbased metal salt of an acidic organic compound with sulfuric acid.

10. The composition of claim 1 wherein the lubricating compositions further comprises (B) a phosphorous or boron antiwear or extreme pressure agent.

11. The composition of claim 10 wherein (B) is selected from the group consisting of a metal dithiophosphate, a phosphoric acid ester or salt thereof, a trihydrocarbyl phosphate, a phosphite, a phosphorus-containing carboxylic ester, ether, or amide, a borated dispersant, an alkali metal or a mixed alkali metal, alkaline earth metal borate, a borated overbased compound, and a borated phospholipid.

12. The composition of claim 10 wherein (B) is a metal salt of a mixture of (a) at least one dithiophosphoric acid and (b) at least one aliphatic or allcyclic carboxylic acid.

13. The composition of claim 10 wherein (B) is a phosphoric acid ester prepared by reacting a dithiophosphoric acid with an epoxide to form an intermediate, and the intermediate is further reacted with a phosphorus acid or anhydride, or a salt of the phosphoric acid ester.

14. The composition of claim 13 wherein (B) is a salt prepared by reacting the phosphoric acid ester with ammonia or an amine.

15. The composition of claim 14 wherein the amine is a tertiary aliphatic primary amine.

16. The composition of claim 10 wherein (B) is a phosphoric acid ester prepared by reacting a phosphorus acid or anhydride with at least one alcohol wherein each alcohol independently contains from about 1 to about 30 carbon atoms, or a salt of the phosphoric acid ester.

17. The composition of claim 10 wherein (B) is tricresylphosphate.

18. The composition of claim 10 wherein (B) is a phosphite selected from the group consisting of a dihydrocarbyl phosphite or a trihydrocarbyl phosphite, wherein each phosphite independently has from 1 to about 30 carbon atoms in each hydrocarbyl group.

19. The composition of claim 10 wherein (B) is a phosphorus-containing carboxylic ester, ether, or amide prepared by reacting a phosphorus acid with an unsaturated amide, ether, or ester.

20. The composition of claim 10 wherein (B) is a borated calcium, magnesium, or sodium overbased sulfonate or carboxylate.

21. The composition of claim 1, further comprising (C) at least one sulfur compound.

22. The composition of claim 21 wherein the sulfur compound is a sulfurized organic compound or a dithiocarbamate containing compound.

23. A lubricating composition comprising a major amount of an oil of lubricating viscosity, (A) a sulfite overbased or borated overbased metal salt of an acidic organic compound prepared by reacting an overbased or borated overbased metal salt of an acidic organic compound with sulfurous acid, sulfurous ester, or sulfurous anhydride, wherein the sulfite overbased or borated overbased metal salt has a metal ratio from about 10 to about 40 and is derived from a carbonated overbased or borated overbased metal salt, and (B) a phosphorus or boron antiwear/extreme pressure agent, wherein the lubricating composition contains less than 1.5% by weight of a reaction product of a polyisobutene substituted succinic anhydride and a polyamine.

24. A lubricating composition comprising a major amount of an oil of lubricating viscosity, (A) a sulfite overbased or borated overbased metal salt of an acidic organic compound prepared by reacting an overbased or borated overbased metal salt of an acidic organic compound with sulfurous acid, sulfurous ester, or sulfurous anhydride, wherein the sulfite overbased or borated overbased metal salt has a metal ratio from about 10 to about 40 and is derived from a carbonated overbased or borated overbased metal salt, and (C) a sulfur compound, wherein the lubricating composition contains less than 1.5% by weight of a reaction product of a polyisobutene substituted succinic anhydride and a polyamine.

25. The composition of claim 24 wherein the sulfur compound (C) is a sulfurized organic compound or a dithiocarbamate containing compound.

26. A gear lubricant composition comprising a major amount of an oil of lubricating viscosity, and an extreme pressure and antiwear or extreme pressure improving amount of (A) a sulfite or a sulfate overbased or borated overbased metal salt of an acidic organic compound, wherein the sulfite overbased or borated overbased metal salt has a metal ratio from about 10 to about 40 and is derived from a carbonated overbased or borated overbased metal salt, wherein the lubricating composition contains less than 1.5% by weight of a reaction product of a polyisobutene substituted succinic anhydride and a polyamine, and provided that when (A) is a sulfate overbased or borated overbased metal salt, the lubricating composition includes (B) at least one phosphorous or boron antiwear or extreme pressure agent or (C) a sulfur compound.

27. A grease composition comprising (A) an oil of lubricating viscosity, (A) a sulfite or a sulfate overbased or borated overbased metal salt of an acidic organic compound, wherein the sulfite overbased or borated overbased metal salt has a metal ratio from about 10 to about 40 and is derived from a carbonated overbased or borated overbased metal salt, and (B) a thickener agent.

28. A lubricating composition prepared by mixturing a major amount of an oil of lubricating viscosity, and a minor amount of (A) a sulfite or sulfate overbased or borated overbased metal salt of an acidic organic compound, wherein the sulfite overbased or borated overbased metal salt has a metal ratio from about 10 to about 40 and is derived from a carbonated overbased or borated overbased metal salt, wherein the lubricating composition contains less than 1.5% by weight of a reaction product of a polyisobutene substituted succinic anhydride and a polyamine, and provided that when (A) is a sulfate overbased or borated overbased metal salt, then the lubricating composition includes (B) at least one phosphorus of boron antiwear or extreme pressure agent, or (C) a sulfur compound.

29. A cutting fluid comprising a cutting fluid base stock and a combination of (A) a sulfite or sulfate overbased or borated overbased metal salt of an acidic organic compound, wherein the sulfite overbased or borated overbased metal salt has a metal ratio from about 10 to about 40 and is derived from a carbonated overbased or borated overbased metal salt, and (C) a sulfur compound.

30. The composition of claim 1 wherein (A) has a metal ratio from about 10 to about 30.

31. The composition of claim 10 wherein (B) is selected from the group consisting of a metal dithiophosphate, a phosphoric acid ester or salt thereof, a trihydrocarbyl phosphate, a phosphite, a phosphorus-containing carboxylic ester, ether, or amide, and a borate ester.

32. The composition of claim 1 wherein the lubricating composition contains less than 1.5% of a dispersant.

* * * * *